US008779991B2

(12) United States Patent
Ali et al.

(10) Patent No.: US 8,779,991 B2
(45) Date of Patent: Jul. 15, 2014

(54) ANTENNA ASSEMBLY WITH ELECTRICALLY EXTENDED GROUND PLANE ARRANGEMENT AND ASSOCIATED METHOD

(75) Inventors: Shirook M. Ali, Waterloo (CA); James Paul Warden, Irving, TX (US); Kelce Steven Wilson, Irving, TX (US)

(73) Assignee: BlackBerry Limited, Waterloo (CA)

( * ) Notice: Subject to any disclaimer, the term of this patent is extended or adjusted under 35 U.S.C. 154(b) by 344 days.

(21) Appl. No.: 12/765,581

(22) Filed: Apr. 22, 2010

(65) Prior Publication Data

US 2011/0260929 A1 Oct. 27, 2011

(51) Int. Cl.
*H01Q 1/24* (2006.01)

(52) U.S. Cl.
USPC ..... 343/702

(58) Field of Classification Search
CPC ..... H01Q 1/24; H01Q 1/38; H01Q 9/0421; H01Q 1/244; H01Q 1/242
USPC ..... 343/702, 700 MS, 788, 866
See application file for complete search history.

(56) References Cited

U.S. PATENT DOCUMENTS

| | | | | |
|---|---|---|---|---|
| 4,521,784 | A | 6/1985 | Nemet | |
| 6,552,686 | B2 | 4/2003 | Ollikainen et al. | |
| 6,963,310 | B2 * | 11/2005 | Horita et al. | 343/702 |
| 6,992,627 | B1 * | 1/2006 | Honda et al. | 343/700 MS |
| 7,012,571 | B1 | 3/2006 | Ozkar et al. | |
| 7,151,955 | B2 * | 12/2006 | Huber et al. | 455/575.5 |
| 7,304,616 | B1 | 12/2007 | Chen et al. | |
| 7,394,432 | B2 | 7/2008 | Baliarda et al. | |
| 2004/0037052 | A1 * | 2/2004 | Wu et al. | 361/752 |
| 2005/0159195 | A1 | 7/2005 | Huber et al. | |
| 2007/0159401 | A1 * | 7/2007 | Baliarda et al. | 343/702 |
| 2008/0252536 | A1 * | 10/2008 | Anguera et al. | 343/702 |
| 2009/0085814 | A1 * | 4/2009 | Johnson | 343/702 |

FOREIGN PATENT DOCUMENTS

| | | |
|---|---|---|
| CA | 2738169 | 10/2011 |
| GB | 24608454 | 12/2009 |
| WO | 2007039071 | 4/2007 |
| WO | 2009037353 | 3/2009 |

OTHER PUBLICATIONS

Extended European Search Report, Application No. 10160785.1, European Patent Office, Nov. 18, 2010, 6 pgs.
EPO, Communication pursuant to Article 94(3) EPC, Application No. 10 160 785.1, Feb. 29, 2012, 5 pgs.
Byndas et al, "Improvement of Compact Terminal Antenna Performance by Incorporating Open-End Slots in Ground Plane," IEEE Transactions on Electromagnetic Compatibility, vol. 14, No. 6, Jun. 2004, pp. 283-285.

(Continued)

*Primary Examiner* — Huedung Mancuso
(74) *Attorney, Agent, or Firm* — The Danamraj Law Group, P.C.

(57) ABSTRACT

Antenna assembly having an electrically or virtually extended ground plane, adapted for use in a mobile communications device, for example. The antenna assembly comprises at least one radiation element having an operating frequency and a ground plane coupled to the radiation element. At least one conductive member is electrically coupled to the ground plane at one or more connection points such that the conductive member forms a loop with the ground plane having a minimum distance therefrom that is less than a predetermined fraction of one wavelength of the operating frequency.

18 Claims, 6 Drawing Sheets

(56) References Cited

OTHER PUBLICATIONS

Kivekas, et al, "Bandwidth, SAR, and Efficiency of Internal Mobile Phone Antennas," IEEE Microwave and Wireless Components Letters, vol. 46, No. 1, Feb. 2004, pp. 71-86.
Seabury, David, "An Update on SAR Standards and the Basic Requirements for SAR Assessment," Conformity, Apr. 2005, 8 pgs.
Vainikainen, Pertti, "Resonator-Based Analysis of the Combination of Mobile Handset Antenna and Chassis," IEEE Transactions on Antennas and Propagation, vol. 50, No. 10, Oct. 2002, pp. 1433-1444.
Wikipedia, "Antenna Measurement," (Retrieved from "http://en.wikipedia.org/wiki/Antenna_measurement," Oct. 10, 2009, 9 pgs.
Wikipedia, "Specific Absorption Rate," (Retrieved from "http://en.wikipedia.org/wiki/Specific_Absorption_Rate," Dec. 23, 2009, 3 pgs.
Ali et al., "Effects of Chassis Currents on Hearing Aids Compatibility in the Handset," IEEE Transactions on Electromagnetic Compatibility, vol. 52, No. 4, Nov. 2010, pp. 837-842.
Ali et al., "Improved Handset Antenna Performance via an Electrically Extended Ground Plane," ISRN Communications and Networking, vol. 2012, Jan. 2012, 7 pgs.
Chiou et al., "Designs of Compact Microstrip Antennas with a Slotted Ground Plan," IEEE Antennas and Propagation Society International Symposium, vol. 2, Jul. 2001, pp. 732-735.
Geyi et al., "Handset Antenna Design: Practice and Theory," Progress in Electromagnetics Research, vol. 80, 2008, pp. 123-160.
Kanj et al., "Compact Multiband Folded 3-D Monopole Antenna," IEEE Antennas and Wireless Propagation Letters, vol. 8, Oct. 2008, pp. 185-188.
Taga et al., "Performance Analysis of a Built-In Planar Inverted F Antenna for 800 MHz Band Portable Radio Units," IEEE Journal on Selected Areas in Communications, vol. 5, No. 5, Jun. 1987, pp. 921-929.
CIPO, Office Action, U.S. Appl. No. 2,738,169, Jun. 26, 2013, 3 pgs.
CIPO, Notice of Allowance, U.S. Appl. No. 2,738,169, Nov. 18, 2013, 1 pg.

* cited by examiner

ANTENNA ASSEMBLY WITH ELECTRICALLY EXTENDED GROUND PLANE ARRANGEMENT AND ASSOCIATED METHOD

FIELD OF THE DISCLOSURE

The present patent disclosure generally relates to antenna assemblies. More particularly, and not by way of any limitation, the present patent disclosure is directed to an antenna assembly with an electrically/virtually extended ground plane arrangement and associated method, the antenna assembly being operable for a wireless communications device or other RF equipment.

BACKGROUND

Recently, there has been an increasing thrust in the application of internal antennas in wireless communications devices. The concept of an internal antenna stems from the avoidance of using an external radiating element through the integration of the antenna into the communications device itself. Internal antennas have several advantageous features such as being less prone to external damage, a reduction in overall size of the communications device with optimization, and easy portability. In most internal antennas, the printed circuit board (PCB) of the communications device serves as the ground plane of the internal antenna.

A known challenge in antenna design is the balance between the size of the ground plane and the antenna performance. While it is known that there may be optimal dimensions for a ground plane in order to achieve the best antenna performance, such dimensions are not always feasible due to the physical constraints of the device itself as well as potential negative impact on the device aesthetics. Some techniques have been presented to control the ground plane wavemodes in order to achieve improved performance, wherein one or more transversal slots on the ground plane are provided. However, such techniques are known to cause undesirable electromagnetic interference issues in addition to being impractical from the standpoint of the ground plane PCB manufacture.

BRIEF DESCRIPTION OF THE DRAWINGS

A more complete understanding of the embodiments of the present patent disclosure may be had by reference to the following Detailed Description when taken in conjunction with the accompanying drawings wherein.

DETAILED DESCRIPTION OF THE DRAWINGS

The present patent disclosure is broadly directed to a scheme for electrically extending the ground plane of any antenna assembly, e.g., operable in a wireless device, while keeping the physical dimensions of the ground plane unchanged. For purposes of the present disclosure, an antenna assembly includes at least one antenna element and a ground plane coupled thereto. In one aspect, an embodiment of an antenna assembly for use with a mobile communications device is disclosed. The claimed antenna assembly embodiment comprises: at least one radiation element having an operating frequency; a ground plane coupled to the at least one radiation element; and at least one conductive member electrically coupled to the ground plane such that the at least one conductive member forms a loop spaced from the ground plane by a distance that is less than a predetermined fraction of one wavelength of the operating frequency, wherein the predetermined frequency is in a range between 0.01 and 0.25 and the conductive member is electrically coupled to the ground plane at one or more separated locations.

In another aspect, an embodiment of a wireless UE device is disclosed. The claimed embodiment comprises a transceiver circuit adapted to effectuate radio frequency (RF) communications in an operating frequency; and an antenna assembly coupled to the transceiver circuit, wherein the antenna assembly includes a ground plane that is electrically extended by virtue of at least one conductive element coupled thereto at one or more locations. The at least one conductive element is spaced from the ground plane by a distance that is less than a predetermined fraction of one wavelength of the operating frequency and forms at least one closed conductive loop with the ground plane, wherein the predetermined frequency is in a range between 0.01 and 0.25.

In a still further aspect, an embodiment of a method for assembling an antenna assembly having at least one radiation element with an operating frequency is disclosed. The claimed method comprises: obtaining a ground plane; and electrically coupling at least one conductive member to the ground plane such that the at least one conductive member forms a loop with the ground plane having a minimum distance that is less than a predetermined fraction of one wavelength of the operating frequency, wherein the predetermined frequency is in a range between 0.01 and 0.25. The conductive member(s) is/are physically connected at one or more connection points to the ground plane such that the member becomes an electrically extended part of the ground plane.

Figure 1:
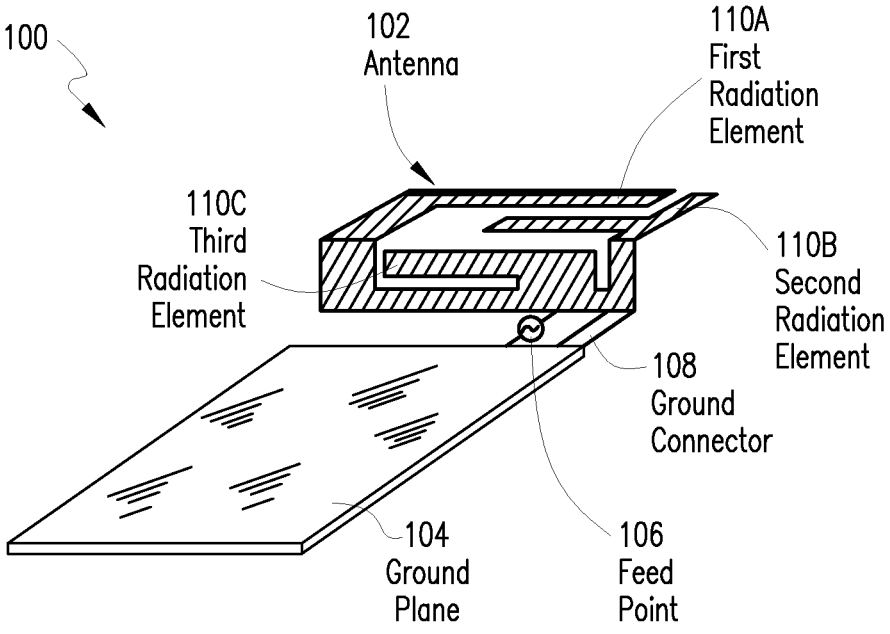
FIG. 1 (PRIOR ART)
FIG. 1 depicts a conventional antenna assembly with a physical ground plane, typically configured to operate in a wireless user equipment (UE) device.

Embodiments of apparatus and associated method relating to an antenna assembly with an electrically extended ground plane of the present patent disclosure will now be described with reference to various examples of how the embodiments can be made and used. Like reference numerals are used throughout the description and several views of the drawings to indicate like or corresponding parts to the extent feasible, wherein the various elements may not necessarily be drawn to scale. Referring now to the drawings, and more particularly to FIG. 1, depicted therein is a perspective view of a conventional antenna assembly 100 with a physical ground plane 104, typically configured to operate in a wireless user equipment (UE) device (not shown). Ground plane 104 may be generally provided as a printed circuit board (PCB) having a radio frequency (RF) shield, and is dimensioned to have a form factor that is compatible with a housing of the UE device. As such, the dimensioning of the physical ground plane is a result of balancing the desired electrical characteristics and the space constraints of the device itself, and is accordingly fixed at predetermined measurements and shape. An antenna module 102 having one or more radiation elements is electrically coupled to the ground plane 104 by way of one or more feed points 106 and one or more ground connectors 108. As an example, a first radiation element 110A, a second radiation element 110B and a third radiation element 110C are illustrated.

Figure 2A:
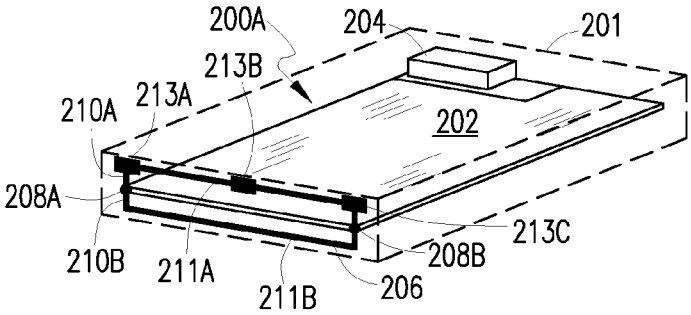
FIG. 2A depicts an example embodiment of an antenna assembly having an electrically/virtually extended ground plane according to the present patent application.

FIG. 2A depicts an example embodiment of an antenna assembly 200A according to the present patent application, wherein a physical ground plane 202 is electrically (i.e., virtually) extended to achieve improved electrical characteristics while conforming to the form factor requirements of a UE device housing 201. Ground plane 202 may comprise a PCB substrate having a suitable RF shield, to which an antenna module or a radiation element 204 may be electrically coupled by way of one or more feed points and ground connectors (not shown). The PCB substrate may be substantially rectangular, square, or any other shape, without limitation, and may be dimensioned to be housed in the housing 201 having any known or heretofore unknown form factors, e.g., rectangular, clam shell, flip phone, slide-out, foldable, morphable, etc. In one example implementation, ground plane 202 may have a length of 100 mm and a width of 50 mm and the device housing 201 may have a height or thickness of H.

Antenna module (or simply, radiation element) 204 is illustrative of any known or heretofore unknown antenna implementation with one or more radiation elements. Each radiation element 204 may be adapted to operate in a certain frequency band (i.e., operating frequency or wavelength) depending on the radio access technologies of the communications networks such as, without limitation, Global System for Mobile Communications (GSM) networks, Enhanced Data Rates for GSM Evolution (EDGE) networks, Integrated Digital Enhanced Networks (IDEN), Code Division Multiple Access (CDMA) networks, Universal Mobile Telecommunications System (UMTS) networks, any 2nd- 2.5- 3rd- or subsequent Generation networks, Long Term Evolution (LTE) networks, or wireless networks employing standards such as Institute of Electrical and Electronics Engineers (IEEE) standards, like IEEE 802.11a/b/g/n standards or other related standards such as HiperLan standard, HiperLan II standard, Wi-Max standard, OpenAir standard, and Bluetooth standard, as well as any satellite-based communications technology such as GPS. Accordingly, it should be realized that an operating frequency of the antenna module 204 may range, for example, from about 600-900 MHz to 1800 MGz for GSM to LTE bands from 2.0 GHz to 2.8 GHz. Further, the radiation elements of the antenna module 204 may comprise any known or heretofore unknown elements such as, e.g., a patch antenna, an inverted F antenna (IFA) strip, a modified inverted F antenna (MIFA) strip, a planar inverted F antenna (PIFA) strip, and the like, in any shape, size and form factor.

At least one conductive member is electrically coupled to the ground plane 202 at one or more contact points such that the at least one conductive member forms a loop that is spaced from the ground plane 202 by a distance (h) in a substantially vertical direction that is less than a predetermined fraction of at least one wavelength of an operating frequency associated with the antenna module 204. The member is physically/electrically connected and coupled to the main ground plane 202 at one or more separated locations that operate as connection points. Because of the physical principles employed in designing the spacing in accordance herewith, areas defined by the conductive member(s) operate, for purposes of reception and transmission of the operating RF signals, as an extended ground coupled to the physical ground plane 202. Thus, a "virtual" extension of the physical ground plane 202 is electrically effectuated that gives rise to improved antenna performance characteristics as will be set forth below.

The wave physics of the RF signals requires that the spacing between the conductive member loop(s) and the physical ground plane 202 be at least no greater than one wavelength for creating an effective electrical extension of the physical plane. By way of experimentation, it has been determined that advantageous results can be obtained where the spacing distance is less than a fraction of one wavelength. If the operating frequency is f (Hz), the wavelength $\lambda$ equals C/f where C=300×E6, the speed of light in m/sec. The spacing distance (h) is then equal to or less than $\tau*\lambda$ where $\tau$ is a factor in the range of from approximately 0.01 up to a fraction of the wavelength $\lambda$ or a multiple thereof, with the additional condition that the spacing distance must also be such that it is less than the height (H) of the device housing 201. In one illustrate embodiment, $\tau$ can be between 0.01 and 0.25 of $\lambda$. Accordingly, for example, at an operating frequency of 900 MHz and $\tau$=0.01, h is 0.333 cm. Likewise, at 1880 MHz and $\tau$=0.01, h is 0.15957 cm. It should therefore be apparent that at higher antenna operating frequencies, the required spacing distances are smaller for purposes of effectuating an effective virtual extension of the physical ground plane 202.

The conductive member(s) may be metallic or non-metallic filaments or wires in a number of gauges (i.e., diameters). Metallic conductive members may be comprised of aluminum, copper, silver, ferrite beads or any metallic element or alloy. Ferrite beads act as low-pass filters, which attenuate high frequencies that may be propagating along a filament, wire or cable. Ferrite beads that are disposed on a conductive element or member, such as a conductive filament, can be used to adjust the frequency response of the entire system. Where multiple conductive members are employed, they can be of different gauges, compositions, etc. Further, the conductive members may have any cross-sectional area such as, without limitation, circular, square, hexagonal, octagonal, and the like, and may be comprised of hollow wires or solid wires having a diameter in a range from about 0.001 mm and on up. In an example implementation, the conductive members have a diameter of about 1.5 mm.

In the embodiment illustrated in FIG. 2A, the conductive member is formed or otherwise shaped into a substantially rectangular loop 206 that is coupled to the physical ground plane 202 at two example contact points 208A and 208B along a width of the ground plane 202. The orientation of the loop 206 may be substantially perpendicular to the ground plane 202 or may have an angle with respect thereto. In one variation, one or more ferrite beads 213A-213C may be disposed along the conductive member loop 206. Additionally, the ground plane 202 may be coupled to the loop 206 such that a top portion 211A and a bottom portion 211B may be equally spaced (h) from the ground plane 202, wherein the full height or width (w) of the loop is 2 h. As a further variation, the top and bottom portions 211A, 211B of the conductive member loop 206 may be unequally spaced from the ground plane 202 so long as each spacing (i.e., top spacing 210A and bottom spacing 210B) satisfies the operating wavelength condition set forth above. The area defined by the conductive member loop 206 may be referred to as a "virtual ground plane" to distinguish it from the physical ground plane 202 of the antenna assembly. With respect to the substantially rectangular loop 206 of FIG. 2A, the area is 2 Wh, where W=width of the physical ground plane 202.

Those skilled in the art will recognize that any number of variations, modifications, alterations, additions, substitutions, constitutions, compositions and the like are possible for configuring one or more conductive members relative to an antenna's physical ground plane in accordance with the teachings of the present patent application. For example, although FIG. 2A illustrates a substantially rectangular conductive member loop 206 that spans the entire width (W) of the physical plane 202, another conductive member loop embodiment may span only a portion of the width of the physical ground plane 202. Likewise, the top and bottom portions 211A, 211B may have certain features such as serrations, notches, protuberances, bumps, ripples, protrusions, and the like, and may comprise either a linear form (i.e., a straight line) or a nonlinear form such as having an arcuate shape (e.g., a bent shape) or a wavy shape. The top and bottom portions 211A, 211B (which may be referred to as first and second portions or vice versa) may be separately disposed as substantially rectangular loops on two separate "sides" of the ground plane (i.e., a length side and a width side). That is, one or more conductive members or portions thereof may be coupled to either a width, length, or both of the physical ground plane 202, either at the edges (i.e., a "shoreline" connection, as illustrated in FIG. 2A) or at a distance interior from the edges thereof. Additionally, a substantial rectangular loop configuration may have a meandering long side, as well as may be non-planar. Some of the example conductive member loop embodiments are illustrated in FIGS. 2B-2H and are described below.

Figure 2B:
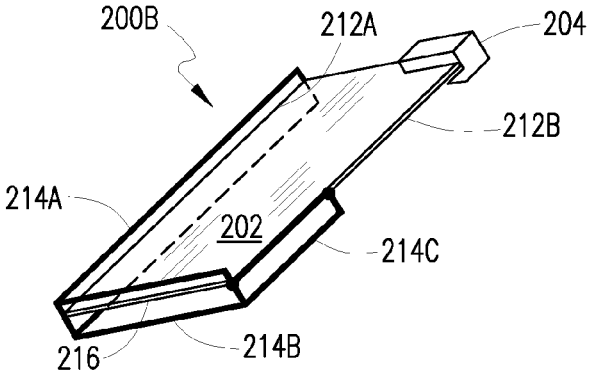
FIGS. 2B-2H several alternative embodiments of an antenna assembly having an electrically/virtually extended ground plane according to the present patent application.

In the embodiment illustrated in FIG. 2B, an antenna assembly 200B includes the physical ground plane 202 and antenna module 204 shown in FIG. 2A but has multiple conductive member loops coupled to the ground plane 202. A full-length first conductive member loop 214A is coupled to a first length 212A of the ground plane 202. A full-width second conductive member loop 214B is coupled to a width 216 of the ground plane 202. In addition, a partial-length third conductive member loop 214C is coupled to a second length 212B of the ground plane 202. Similarly, the embodiments of FIGS. 2C-2H illustrate various antenna assemblies 200C-200H, each having the antenna module 204 and associated physical ground plane 202, in addition to the example conductive member configurations. Antenna assembly 200C includes a full-width conductive member loop 222 as well as a full-length conductive member loop 224 having multiple notches 228-1, 228-2 formed therein. It should be recognized that multiple notches 228-1, 228-2 may be equally or unequally spaced along the conductive member loop 224. Antenna assembly 200D of FIG. 2D includes a partial-length conductive member loop 232A, a full-length conductive member loop 232B as well as a full-width conductive member loop 232C, wherein the partial-length conductive member loop 232A extends on both sides of the physical ground plane 202. Antenna assembly 200E is illustrative of a configuration where only a single full-length conductive member loop 240 is coupled to a length of the physical ground plane 202. Antenna assembly 200F is illustrative of a configuration having only a single partial-length, full-height conductive member loop 250 is coupled to a length of the physical ground plane 202, wherein the conductive member loop 250 extends on both sides of the ground plane 202. Antenna assembly 200G is illustrative of a configuration having only a single partial-length, partial-height conductive member loop 260 is coupled to a length of the physical ground plane 202, wherein the conductive member loop 260 extends on only one side (e.g., a bottom side) of the ground plane 202. It can be seen in this configuration that at least a first portion of the conductive member 260 may be shaped as three sides of a first substantially rectangular loop and a first portion of 202 ground plane (here, the portion being along the length of the ground plane) forms a fourth side of the rectangular loop 260. As a further variation of the configuration 200G, the fourth side (i.e., the long side) of the loop 260 may also have one or more notches such as those shown in the configuration 200C of FIG. 2C. Antenna assembly 200H of FIG. 2H is substantially similar to the configuration shown in FIG. 2D, except that the conductive member loops 270A-270C are thinner in diameter than the conductive member loops 232A-232C (each being about 1 mm in diameter).

Figure 3:
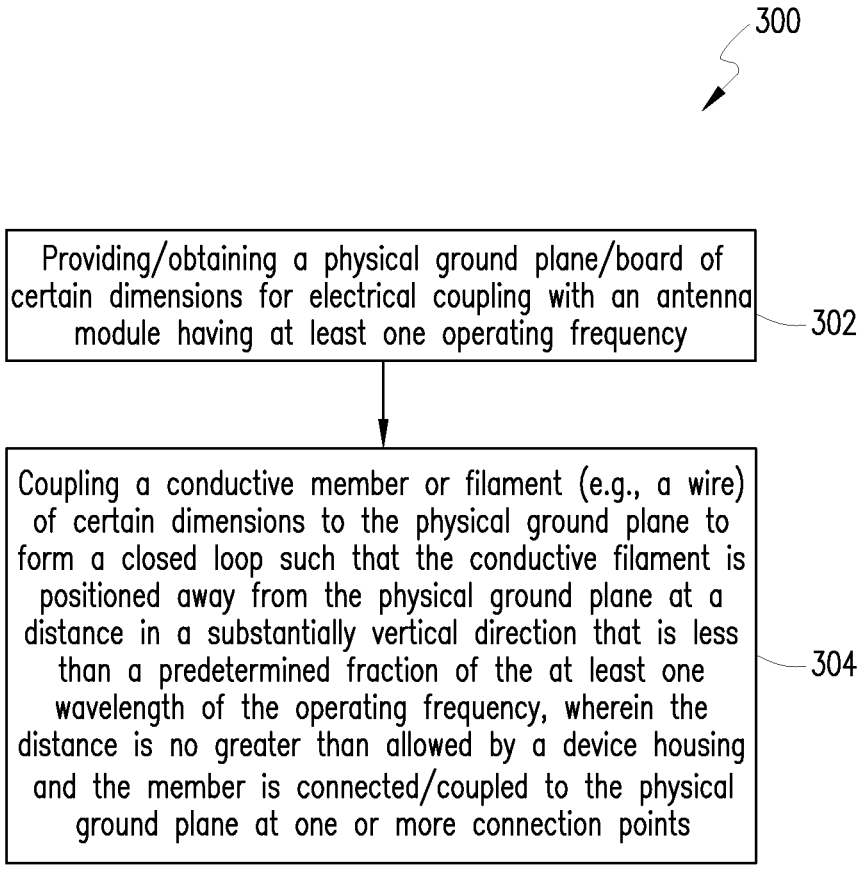
FIG. 3 is a flowchart of an example method of the present patent application.

FIG. 3 is a flowchart of an example method of the present patent application for assembling or otherwise making an embodiment of an antenna assembly in accordance with the teachings herein. A physical ground plane or board having certain dimensions is provided, supplied or otherwise obtained for coupling with an antenna module having one or more radiation elements, thus having at least one operating frequency (block 302). A conductive member or filament (e.g., a wire) of certain dimensions is coupled to the physical ground plane to form a loop such that the conductive member is positioned away from the physical ground plane at a minimum distance in a substantially vertical direction (i.e., either perpendicular or at some angle relative to the ground plane) that is less than a predetermined fraction of one wavelength of the operating frequency. The conductive member may be coupled to the physical ground plane at one or more connection points. In one variation where multiple operating frequencies are involved, the shortest wavelength may be used for determining the spacing between the conductive member(s) and the physical ground plane. Furthermore, the spacing between the conductive member(s) and the physical ground plane is also constrained such that it is no greater than allowed by a device housing in which the antenna assembly is to be placed. These operations are set forth in block 304.

It can be appreciated that the foregoing approach of using one or more elongated conductive members to build electrically extended parts of a ground plane exploits the physical phenomenon wherein the proximity of the members to the ground plane results in an appearance of a single solid electrical surface that is larger than the physical ground plane itself. In general, the electrically extended surface is about the area bounded by the loop into which a conductive member may be formed. Additionally, the dimensions of the conductive member(s) depend on the frequency in which an improvement in the antenna performance is sought. Since the conductive members are disposed outside the plane of the physical ground substrate, they can be placed within the volume normally enclosed by a device without requiring its housing to be lengthened, thereby avoiding extra cost of manufacture (associated with enlarged housing) while improving antenna performance.

It should be further appreciated that the virtual extension approach set forth above not only provides improved electrical characteristics but also allows for the use of smaller handset device form factors that are more appealing to the user. It has been observed that the embodiments of the present disclosure improve (i.e., reduce) the Specific Absorption Rate (SAR) levels measured at both low bands (e.g., 800-900 MHz) and high bands (e.g., 1880 MHz), thereby achieving easier compliance with the Federal Communications Commission (FCC) regulations.

Antenna bandwidth as well as the efficiency parameters are also improved at both the low and high bands. The following Tables set forth example measurements for the embodiments set forth in FIGS. 2A-2H:

TABLE 1

Figure 2C:
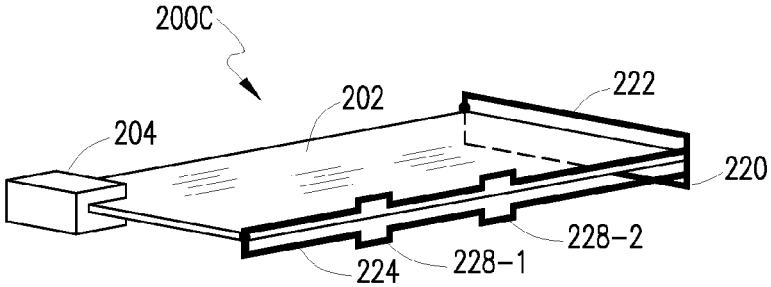
Figure 2D:
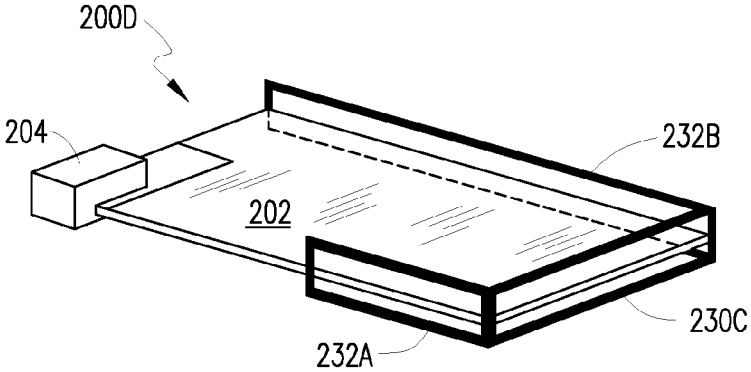
Figure 2E:
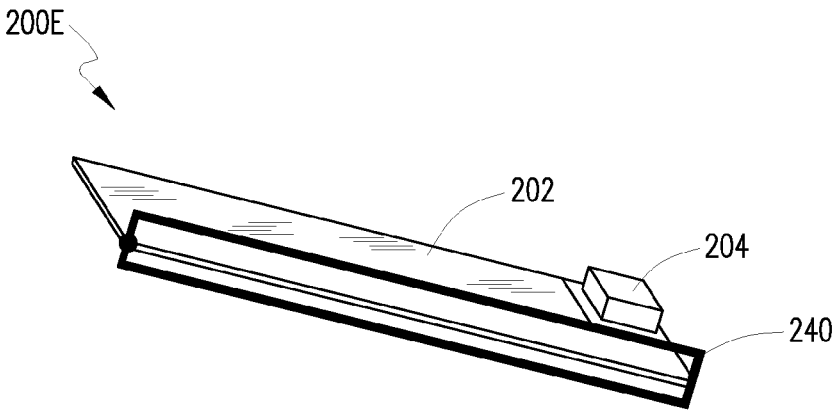
Figure 2F:
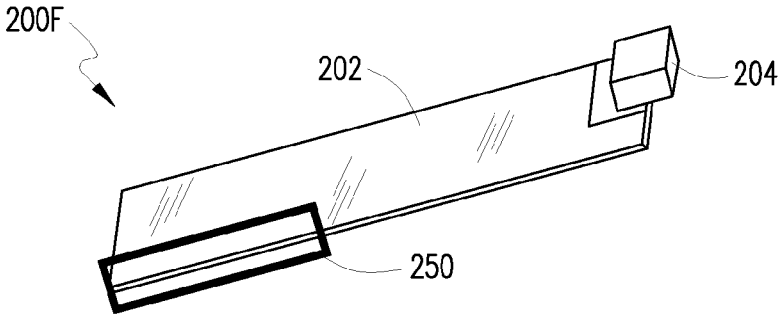
Figure 2G:
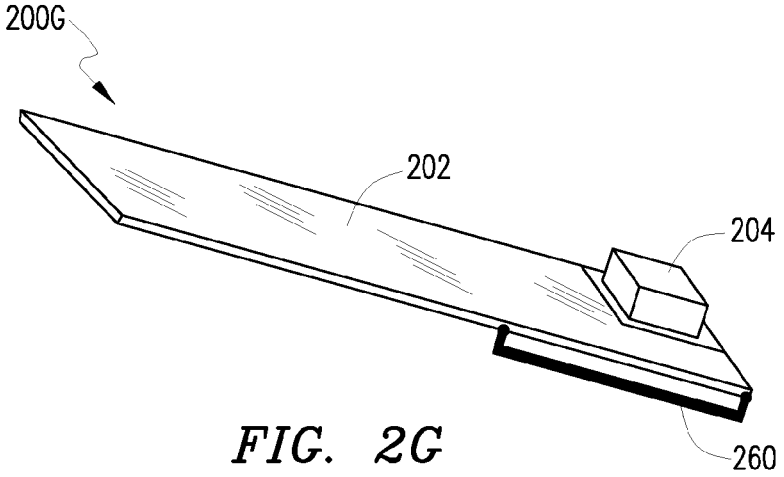
Figure 2H:
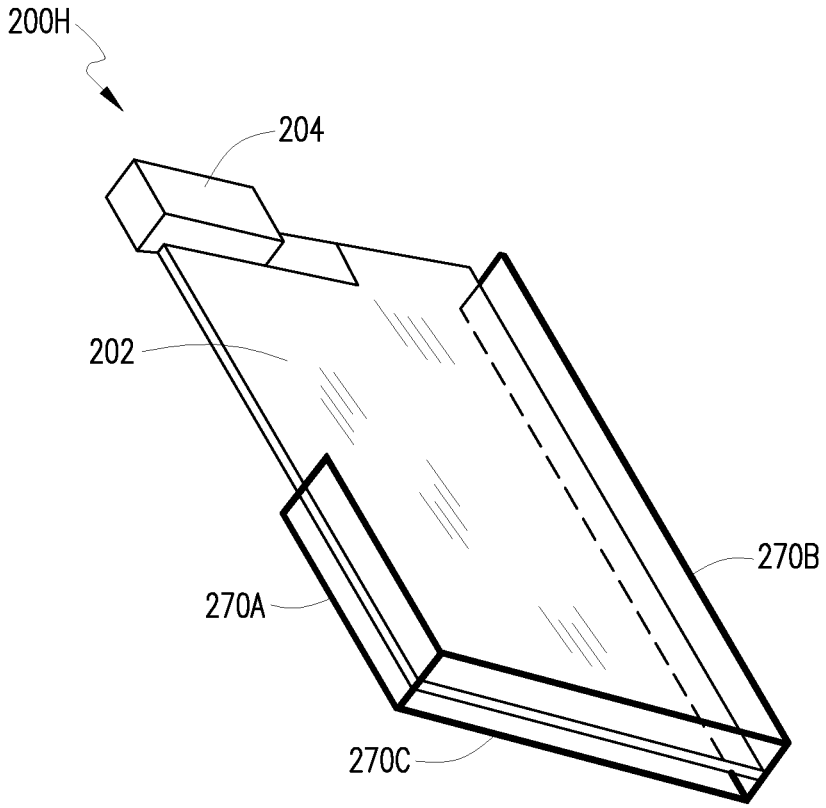

| Improvement in antenna performance at 900 MHz | | | |
|---|---|---|---|
| Embodiment | Improvement/ Increase in efficiency (%) | Improvement/ Increase in Bandwidth (%) | Improvement/ Reduction in SAR (%) |
| FIG. 2A | 4.25 | 28.10 | 3.12 |
| FIG. 2B | 5.06 | 22.16 | 10.45 |
| FIG. 2C | 2.68 | 28.13 | 8.78 |
| FIG. 2D | 2.63 | 14.81 | 11.99 |
| FIG. 2E | 7.70 | 56.44 | 8.11 |
| FIG. 2F | 5.60 | 34.17 | 0.33 |
| FIG. 2G | 4.15 | 44.77 | 5.50 |
| FIG. 2H | 6.15 | 35.23 | 9.87 |

TABLE 2

| Improvement in antenna performance at 1880 MHz | | | |
|---|---|---|---|
| Embodiment | Improvement/ Increase in efficiency (%) | Improvement/ Increase in Bandwidth (%) | Improvement/ Reduction in SAR (%) |
| FIG. 2A | 0 | −1.30 | 12.50 |
| FIG. 2B | −0.35 | 9.90 | 0 |
| FIG. 2C | 1.19 | −3.89 | 0.39 |
| FIG. 2D | 0.96 | 5.24 | −1 |
| FIG. 2E | 1.25 | 11.66 | 1.47 |
| FIG. 2F | 0.60 | 6.06 | 19.63 |
| FIG. 2G | 0.67 | 5.10 | 18.73 |
| FIG. 2H | 0.77 | 8.10 | −0.3 |

Figure 4:
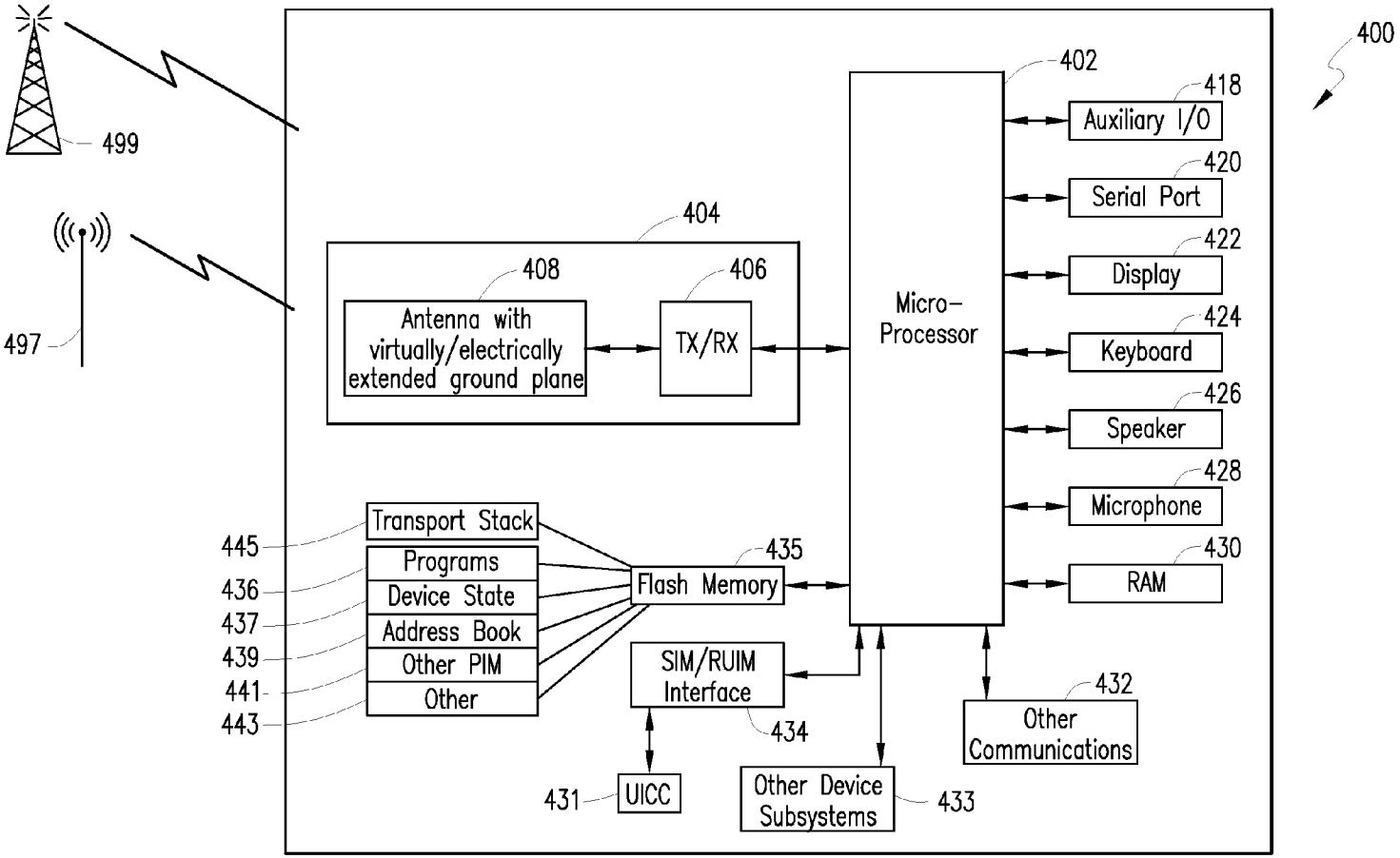
FIG. 4 depicts a block diagram of an example mobile communications device according to one embodiment of the present patent application.

FIG. 4 depicts a block diagram of an example mobile communications device (MCD) 400 having an antenna assembly 408 with a virtually/electrically extended ground plane according to one embodiment of the present patent disclosure. A microprocessor 402 providing for the overall control of MCD 400 is operably coupled to a communication subsystem 404, which includes the antenna assembly 408 coupled to suitable transceiver circuit(s) 406 depending on the access technologies, operating bands/frequencies and networks (for example, to effectuate multi-mode communications in voice, data, media, or any combination thereof). As will be apparent to those skilled in the field of communications, the particular design of the communication module 404 may be dependent upon the communications network(s) with which the device is intended to operate, e.g., as exemplified by infrastructure elements 499 and 487.

Microprocessor 402 also interfaces with additional device subsystems such as auxiliary input/output (I/O) 418, serial port 420, display 422, keyboard 424, speaker 426, microphone 428, random access memory (RAM) 430, other communications facilities 432, which may include for example a short-range communications subsystem, and any other device subsystems generally labeled as reference numeral 433. To support access as well as authentication and key generation, a SIM/USIM interface 434 (also generalized as a Removable User Identity Module (RUIN) interface) is also provided in communication with the microprocessor 402 and a UICC 431 having suitable SIM/USIM applications.

Operating system software and other system software may be embodied in a persistent storage module 435 (i.e., non-volatile storage) which may be implemented using Flash memory or another appropriate memory. In one implementation, persistent storage module 435 may be segregated into different areas, e.g., transport stack 445, storage area for computer programs 436, as well as data storage regions such as device state 437, address book 439, other personal information manager (PIM) data 441, and other data storage areas generally labeled as reference numeral 443. Additionally, the persistent memory may include appropriate software/firmware necessary to effectuate multi-mode communications in conjunction with one or more subsystems set forth herein under control of the microprocessor 402.

It should be recognized that at least some of the various arrangements set forth in the Figures of the present application may comprise a number of variations and modifications, in hardware, software, firmware, or in any combination, usually in association with a processing system where needed, as components configured to perform specific functions. Accordingly, the arrangements of one or more of the Figures should be taken as illustrative rather than limiting with respect to the embodiments of the present patent application.

It is believed that the operation and construction of the embodiments of the present patent application will be apparent from the Detailed Description set forth above. While example embodiments have been shown and described, it should be readily understood that various changes and modifications could be made therein without departing from the scope of the present disclosure as set forth in the following claims.

What is claimed is:

1. An antenna assembly comprising:

at least one radiation element having an operating frequency;

a ground plane coupled to said at least one radiation element; and at least one conductive member that comprises one of a wire, a metallic filament and a non-metallic conductive filament and is directly coupled to said ground plane at separated locations such that said at least one conductive member forms at least one closed loop that includes said ground plane, said closed loop extending substantially perpendicular to said ground plane and having a spacing from said ground plane that is less than a predetermined fraction of one wavelength of said operating frequency, said predetermined fraction being in a range between 0.01 and 0.25.

2. The antenna assembly of claim 1 wherein said at least one conductive member comprises a wire having a diameter in a range of 0.001 mm to 1.5 mm.

3. The antenna assembly of claim 1 further comprising a plurality of ferrite beads disposed on said at least one conductive member.

4. The antenna assembly of claim 1 wherein said distance by which said at least one conductive member is spaced from said ground plane is less than a height of a housing in which said antenna assembly is placed.

5. The antenna assembly of claim 1 wherein a first portion of said at least one conductive member is shaped as three sides of a first substantially rectangular loop, and further wherein a first portion of said ground plane forms a fourth side of said first substantially rectangular loop.

6. The antenna assembly of claim 5 wherein said fourth side is longer than at least two of said three sides of said first substantially rectangular loop.

7. The antenna assembly of claim 5 wherein a longest side of said three sides comprises a plurality of notches.

8. The antenna assembly of claim 5 wherein a second portion of said at least one conductive member is shaped as three sides of a second substantially rectangular loop, and wherein a second portion of said ground plane forms a fourth side of said second substantially rectangular loop.

9. The antenna assembly of claim 8 wherein said first substantially rectangular loop and said second substantially rectangular loop share one side, and wherein said first portion of said ground plane is different than said second portion of said ground plane.

10. The antenna assembly of claim 1 wherein said operating frequency is within a range from 600 MHz to 2.8 GHz.

11. The antenna assembly of claim 1 wherein said at least one radiation element comprises one selected from the list consisting of a patch antenna, an inverted F antenna (IFA), a modified F antenna and a planar inverted F antenna (PIFA).

12. A wireless user equipment (UE) device, comprising:

a transceiver circuit adapted to effectuate radio frequency (RF) communications in an operating frequency; and an antenna assembly coupled to said transceiver circuit, wherein said antenna assembly includes a ground plane that is electrically extended by virtue of at least one conductive element that comprises one of a wire, a metallic filament and a non-metallic conductive filament and is coupled directly thereto at separated locations to form at least one closed loop that includes said ground plane, said at least one closed loop extending substantially perpendicular to said ground plane and having a spacing from said ground plane that is less than a predetermined fraction of one wavelength of said operating frequency, said predetermined fraction being in a range between 0.01 and 0.25.

13. The wireless UE device of claim 12 wherein said operating frequency is within a range from 600 MHz to 2.8 GHz.

14. The wireless UE device of claim 12 wherein said antenna assembly further includes at least one radiation element selected from the list consisting of a patch antenna, an inverted F antenna (IFA), a modified F antenna strip and a planar inverted F antenna (PIFA).

15. The wireless UE device of claim 12 wherein said at least one conductive loop is shaped as a substantially rectangular loop.

16. The wireless UE device of claim 12 wherein said at least one conductive loop is shaped as a substantially rectangular loop that is coupled to said ground plane along a length of said ground plane.

17. The wireless UE device of claim 12 wherein said at least one conductive loop is formed from a conductive member having a diameter in a range of 0.001 mm to 1.5 mm.

18. A method for assembling an antenna assembly having at least one radiation element with an operating frequency, said method comprising:

obtaining a ground plane; and directly coupling at least one conductive member that comprises one of a wire, a metallic filament and a non-metallic conductive filament to said ground plane such that said at least one conductive member forms a closed loop that includes said ground plane, said closed loop extending substantially perpendicular to said ground plane and having a spacing from said ground plane that is less than a predetermined fraction of one wavelength of said operating frequency, said predetermined fraction being in a range between 0.01 and 0.25.

* * * * *